US009257770B2

(12) United States Patent
Ju

(10) Patent No.: US 9,257,770 B2
(45) Date of Patent: Feb. 9, 2016

(54) ELECTRICAL CONNECTOR WITH A PLURALITY OF CONTACTS RECIVED IN A PLURALITY OF SLOTS IN A PLURALITY OF ELASTIC BODIES INTEGRALLY FORMED WITH AN INSULATING BODY

(71) Applicant: LOTES CO., LTD, Keelung (TW)

(72) Inventor: Ted Ju, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 14/575,678

(22) Filed: Dec. 18, 2014

(65) Prior Publication Data

US 2015/0214648 A1 Jul. 30, 2015

(30) Foreign Application Priority Data

Jan. 26, 2014 (CN) ..... 2014 2 0049521

(51) Int. Cl.

| | |
|---|---|
| ***H01R 12/00*** | (2006.01) |
| ***H01R 13/03*** | (2006.01) |
| ***H01R 12/71*** | (2011.01) |
| ***H01R 12/73*** | (2011.01) |

(52) U.S. Cl.

CPC ..... *H01R 13/03* (2013.01); *H01R 9/096* (2013.01); *H01R 12/714* (2013.01); *H01R 12/73* (2013.01)

(58) Field of Classification Search

CPC .... H01R 9/096; H01R 12/79; H01R 13/2414; H01R 13/2435; H01R 13/722; H01R 13/725

USPC ..... 439/65, 66, 69, 74, 248

See application file for complete search history.

(56) References Cited

U.S. PATENT DOCUMENTS

| | | | | |
|---|---|---|---|---|
| 5,324,205 | A * | 6/1994 | Ahmad | H01R 12/714 439/66 |
| 6,447,304 | B1 * | 9/2002 | Korsunsky | H01R 13/2435 439/108 |
| 7,255,574 | B1 * | 8/2007 | Ju | H01R 13/03 439/66 |
| 7,402,050 | B2 * | 7/2008 | Ju | H05K 7/1069 439/66 |
| 2005/0170674 | A1 * | 8/2005 | Lu | H01R 4/027 439/66 |
| 2009/0017698 | A1 * | 1/2009 | Ju | H01R 9/223 439/709 |
| 2009/0023311 | A1 * | 1/2009 | Goodman | H05K 7/1061 439/66 |
| 2015/0207259 | A1 * | 7/2015 | Ju | H01R 13/434 439/751 |

* cited by examiner

*Primary Examiner* — Chandrika Prasad

(74) *Attorney, Agent, or Firm* — Locke Lord LLP; Tim Tingkang Xia, Esq.

(57) ABSTRACT

An electrical connector for connecting a first electronic element and a second electronic element, includes an insulating body, multiple elastic bodies integrally formed with the insulating body, and multiple conductors. Each of the elastic bodies has a receiving slot, and each conductor is received in a corresponding receiving slot in an inclined manner. The receiving slot has a first urging portion and a second urging portion respectively providing an inclined upward elastic counterforce and an inclined downward elastic counterforce against the conductor, so that the conductor has a large normal force. Multiple stopping portions of the receiving slot and multiple shoulder portions of the conductor are in clearance fit, so that the conductor can be displaced vertically in the receiving slot when receiving a force.

22 Claims, 15 Drawing Sheets

ELECTRICAL CONNECTOR WITH A PLURALITY OF CONTACTS RECIVED IN A PLURALITY OF SLOTS IN A PLURALITY OF ELASTIC BODIES INTEGRALLY FORMED WITH AN INSULATING BODY

CROSS-REFERENCE TO RELATED APPLICATION

This non-provisional application claims priority under 35 U.S.C. §119(a) on Patent Application No. 201420049521.1 filed in P.R. China on Jan. 26, 2014, the entire contents of which are hereby incorporated by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD OF THE INVENTION

The present invention relates to an electrical connector, and more particularly to an electrical connector having elastic bodies.

BACKGROUND OF THE INVENTION

Chinese Patent No. CN200510102130.7 discloses an electrical connector. The electrical connector includes an insulating body and a plurality of conductive terminals. The insulating body is provided with a plurality of accommodating holes for correspondingly accommodating the plurality of conductive terminals. Each of the conductive terminals has a contact portion protruding out of the corresponding accommodating hole. The contact portion has a bent portion bent downwards. An elastic plastic is provided between the insulating body and the bent portion. When a chip module is mounted on the electrical connector to urge against the contact portion of the conductive terminal, the bent portion presses against the elastic plastic. The elastic plastic is substantially strip-shaped, and can improve the mechanical performance when the conductive terminal is in contact with the chip module. However, since the bent portion of the contact portion directly presses against the elastic plastic, deformation of the contact portion is limited when the conductive terminal is pressed. As a result, the problem of insufficient normal force (or positive force) cannot be solved.

In many cases, due to reasons such as the technological level or environmental factors, contact pads on the chip module that are used for contact with the contact portions are staggered at different heights, and some of the contact portions cannot be in good electrical contact with the chip module, thus affecting the electrical connection between the chip module and the electrical connector.

Therefore, a heretofore unaddressed need exists in the art to address the aforementioned deficiencies and inadequacies.

SUMMARY OF THE INVENTION

In one aspect, the present invention is directed to an electrical connector having a plurality of elastic bodies and capable of enabling conductors to have a large normal force.

In one embodiment, the electrical connector for electrically connecting a first electronic element and a second electronic element, includes an insulating body, a plurality of elastic bodies, and a plurality of conductors. The insulating body has a top surface and a bottom surface. A plurality of receiving spaces runs through the top surface and the bottom surface. The plurality of elastic bodies is correspondingly located in the plurality of receiving spaces of the insulating body. A receiving slot is formed through each of the elastic bodies. The receiving slot has a first opening and a second opening. The first opening and the second opening are staggered in a vertical direction. Two opposite sides of the receiving slot respectively have a first urging portion and a second urging portion. The plurality of conductors is correspondingly received in the plurality of receiving slots. Each of the conductors has a tilt angle with respect to the bottom surface. Each of the conductors includes a body portion, and a first contact portion and a second contact portion are respectively extend upwards and downwards from the body portion and are exposed out of the top surface and the bottom surface to contact the first electronic element and the second electronic element. The first urging portion is adjacent to the first contact portion and presses against a first side of the body portion. When the first contact portion is pressed, the first urging portion provides an inclined upward elastic counterforce for the first contact portion. The second urging portion is adjacent to the second contact portion and presses against a second side of the body portion. The second side and the first side are disposed opposite to each other. When the second contact portion is pressed, the second urging portion provides an inclined downward elastic counterforce for the second contact portion.

In one embodiment, the body portion further has a third side and a fourth side disposed opposite to each other. The first side and the second side are connected to the third side and the fourth side. The third side or the fourth side is provided with at least one shoulder portion, the receiving slot is provided with at least one stopping portion, the stopping portion is located below or above the corresponding shoulder portion to prevent the conductor from falling off from below or above the receiving slot. In a further embodiment, the receiving slot has two stopping portions, the third side or the fourth side has one shoulder portion, and the two stopping portions are respectively located above and below the shoulder portion.

In one embodiment, the conductor has two shoulder portions protruding from the first side or the second side of the body portion, the receiving slot is provided with at least one stopping portion, and the two shoulder portions are respectively located above and below the stopping portion.

In one embodiment, a floating space exists between the stopping portion and the corresponding shoulder portion.

In one embodiment, the tilt angle between the conductor and the bottom surface is greater than 45° and less than 80°.

In one embodiment, when the first contact portion and the second contact portion are pressed, the first contact portion or the second contact portion of at least one of the conductors is at a different height from the first contact portions or the second contact portions of the other conductors. When the first contact portion and the second contact portion are pressed, the tilt angle of at least one of the conductors with respect to the bottom surface is different from the tilt angles of the other conductors with respect to the bottom surface.

In one embodiment, the elastic bodies are insert molded with the insulating body.

In one embodiment, a panel is connected to the plurality of elastic bodies and is located on the top surface or the bottom surface of the insulating body, and the panel and the elastic bodies are made of a same material. The panel is selectively provided with a plurality of mating holes and a plurality of columns. The top surface or the bottom surface is provided with a plurality of columns for correspondingly mating with the plurality of mating holes, or provided with a plurality of mating holes for correspondingly mating with the plurality of columns. In one embodiment, the electrical connector has two panels, and the two panels are respectively located on the top surface and the bottom surface.

In one embodiment, at least two of the receiving spaces are communicated with each other in a horizontal direction.

In one embodiment, the conductor is substantially a flat plate structure, a straight column structure, or a straight cylinder structure.

In one embodiment, at least one of the first contact portion and the second contact portion is coated with a low-melting point metal.

In one embodiment, the elastic body includes two surfaces disposed opposite to each other. At least one of the surfaces is formed with a plurality of notches correspondingly communicated with the plurality of receiving slots. Each of the notches accommodates a low-melting point metal, and the low-melting point metal covers the first contact portion or the second contact portion. The low-melting point metal is gallium or gallium alloy, and the low-melting point metal is in liquid form.

In one embodiment, a plurality of limiting walls protrudes from a periphery of the insulating body to limit displacement of the first electronic element in a horizontal direction. The insulating body further has a plurality of protruding portions supporting the first electronic element. The protruding portions are located at a periphery of the top surface and are higher than the top surface.

In one embodiment, at least one protruding rib is formed around the receiving space. The protruding rib is higher than the top surface and supporting the first electronic element.

In one embodiment, a plurality of positioning members are provided on one of the insulating body and the second electronic element, and a plurality of positioning holes correspondingly matching with the plurality of positioning members are defined in the other of the insulating body and the second electronic element, and the positioning members are correspondingly fixed in the positioning holes.

As compared with the related art, certain embodiments of the present invention, among other things, have the following beneficial advantages.

(1) The conductor has a tilt angle with respect to the bottom surface, so that the first contact portion and the second contact portion are not in a same vertical line. The first urging portion urging against the first side of the body portion can provide an inclined upward elastic counterforce for the first contact portion, and the second urging portion urging against the second side of the body portion can provide an inclined downward elastic counterforce for the second contact portion. This not only provides the first contact portion and the second contact portion with good mechanical performance, but also enables the first contact portion and the second contact portion to have a large normal force, thereby ensuring a good electrical contact of the first contact portion and the second contact portion to the first electronic element and the second electronic element.

(2) Due to the existence of the floating space between the stopping portion and the shoulder portion, when the first contact portion and the second contact portion are press-fit to the first electronic element and the second electronic element, the conductor can be displaced vertically for proper self-adjustment, so as to adapt to the case in which the first electronic element, the second electronic element and the plurality of conductors have poor flatness, thereby ensuring a good contact of the first contact portion and the second contact portion to the first electronic element and the second electronic element, and facilitating the electrical connection of the first electronic element to the second electronic element.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
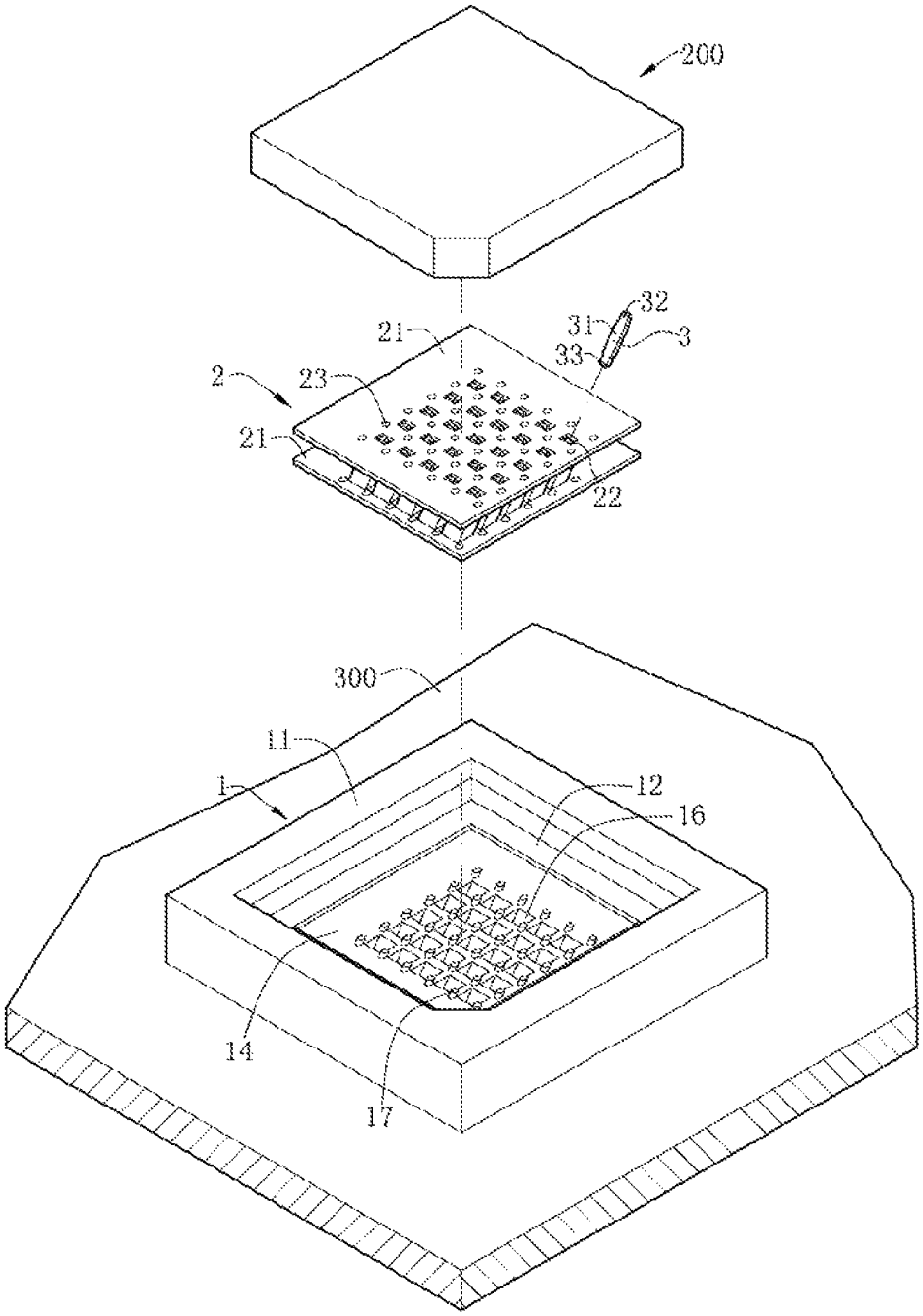
FIG. 1 is a schematic three-dimensional exploded view of an electrical connector according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-15. In accordance with the purposes of this invention, as embodied and broadly described herein, this invention, in one aspect, relates to an electrical connector.

Figure 2:
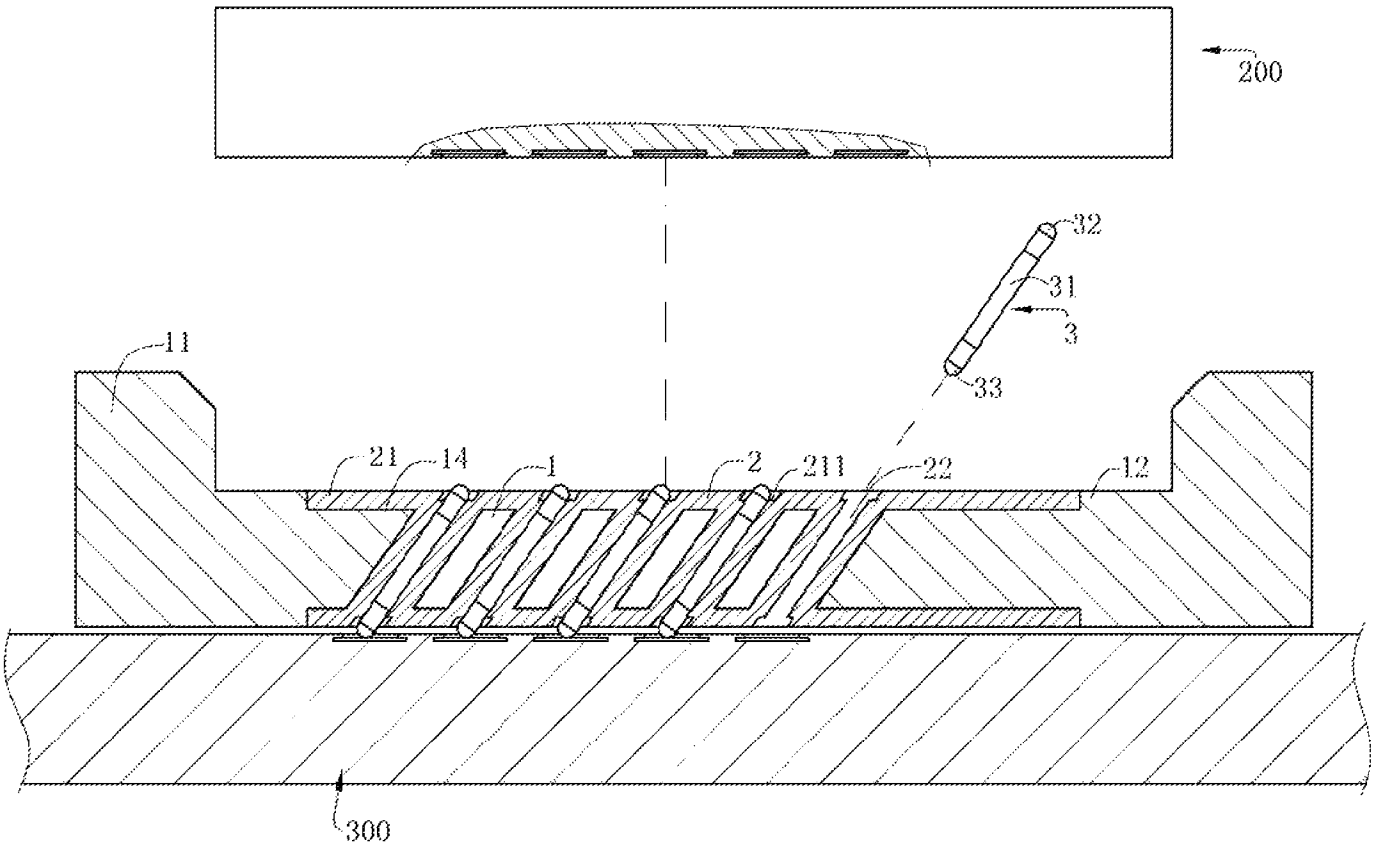
FIG. 2 is a schematic sectional side view of the electrical connector before a chip module is mounted according to one embodiment of the present invention.

As shown in FIG. 1 to FIG. 2, in one embodiment, an electrical connector 100 is used for electrically connecting a first electronic element to a second electronic element. The electrical connector 100 includes an insulating body 1, a plurality of elastic bodies 2 received in the insulating body 1 and insert molded with the insulating body 1, and a plurality of conductors 3 correspondingly received in the plurality of elastic bodies 2.

In one embodiment, the first electronic element is a chip module 200 and the second electronic element is a circuit board 300.

Figure 12:
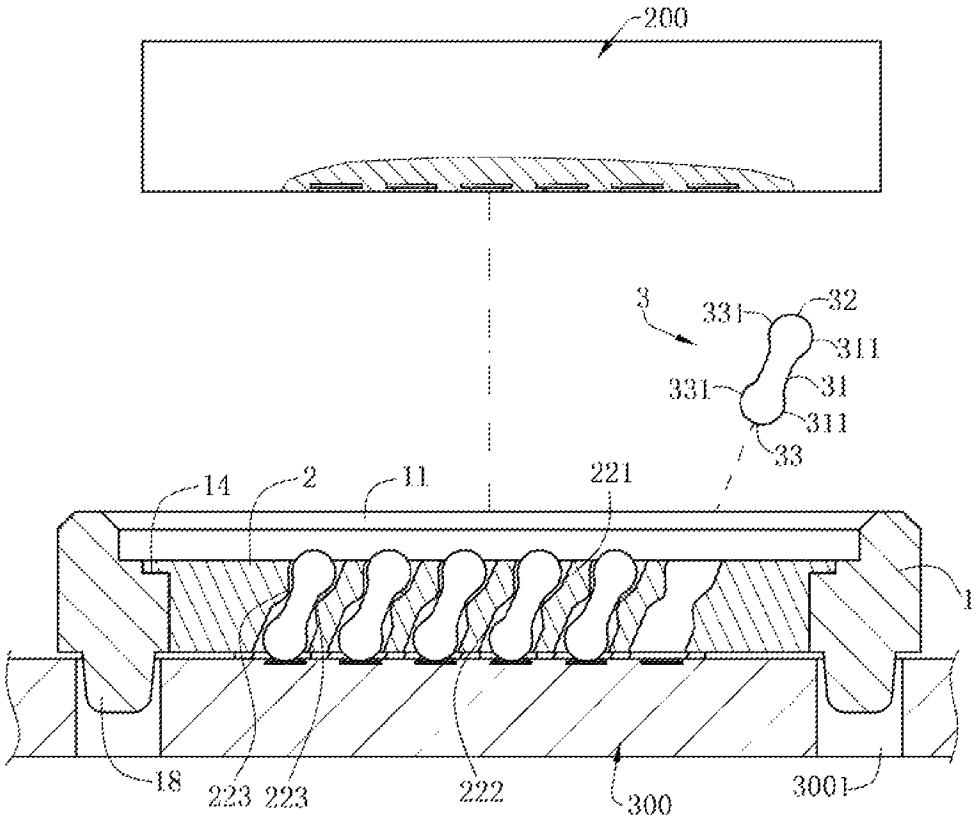
FIG. 12 is a schematic sectional side view of an electrical connector having positioning members according to one embodiment of the present invention.
Figure 13:
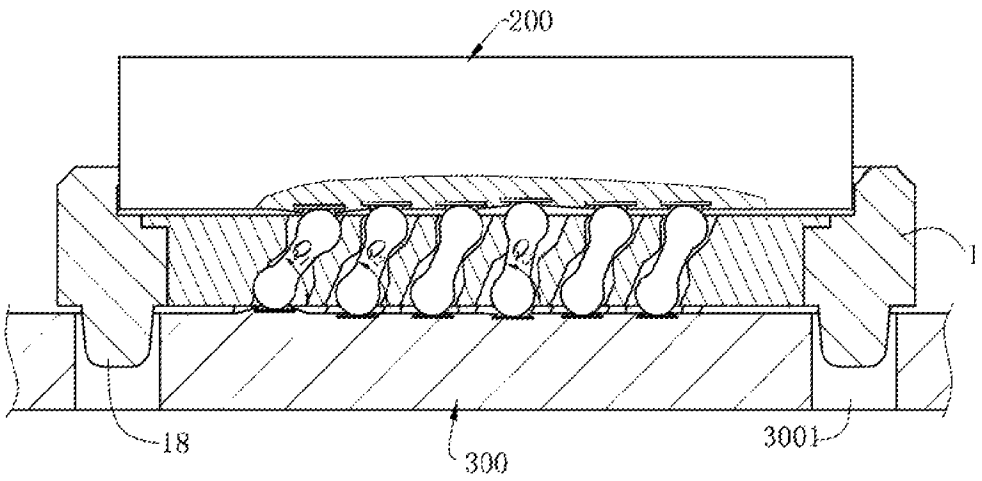
FIG. 13 is a schematic sectional side view showing the change of tilt angles of conductors that are pressed after the chip module in FIG. 12 is mounted.
Figure 14:
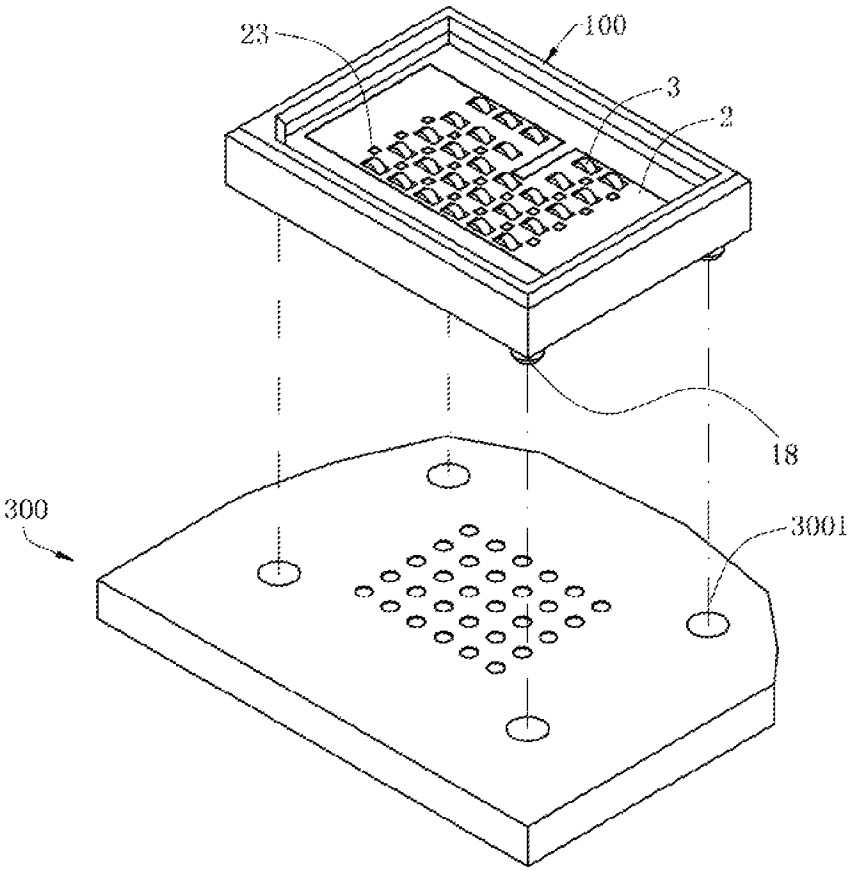
FIG. 14 is a schematic three-dimensional exploded view of FIG. 12.

As shown in FIGS. 1-3 and 6-8, the insulating body 1 is located between the chip module 200 and the circuit board 300. A plurality of limiting walls 11 protrudes from a periphery of the insulating body 1 and is used for limiting displacement of the chip module 200 in a horizontal direction, so as to prevent dislocation of the chip module 200 on the insulating body 1. In one embodiment, four limiting walls 11 are provided, and the four limiting walls 11 are connected end to end. The insulating body 1 has a top surface 14 and a bottom surface (not labeled) that are disposed opposite to each other. A plurality of receiving spaces 16 runs through the top surface 14 and the bottom surface. Four end-to-end connected protruding portions 12 protrude from the top surface 14 and are located at a periphery of the top surface 14, adjacent to an inner side of the limiting walls 11, and used for supporting the chip module 200. Alternatively, in other embodiments, a plurality of protruding ribs 13 is provided around the plurality of receiving spaces 16 to support the chip module 200. Four protruding ribs 13 may be provided around each of the receiving spaces 16, and the four protruding ribs 13 are connected end to end. As shown in FIGS. 12-14, four positioning members 18 are disposed on an end surface, adjacent to the circuit board 300, of the insulating body 1. In one embodiment, the four positioning members 18 are located at four corners of the insulating body 1 respectively, and alternatively the locations of the positioning members 18 are not limited thereto. Four positioning holes 3001 are correspondingly formed in the circuit board 300, and the four positioning members 18 are fixed in the four positioning holes 3001 to prevent displacement of the insulating body 1 on the circuit board 300 or even disengagement of the insulating body 1 from the circuit board 300 due to an unintentional external force. Alternatively, in other embodiments, four positioning holes 3001 are formed in the end surface of the insulating body 1 that is adjacent to the circuit board 300. In the embodiment, not limited thereto, the four positioning holes 3001 are located at four corners of the insulating body 1 respectively, the circuit board 300 is correspondingly provided with four positioning members 18, and the four positioning members 18 are fixed in the four positioning holes 3001, so that the insulating body 1 is stably mounted on the circuit board 300.

As shown in FIG. 1, the plurality of elastic bodies 2 is correspondingly received in the plurality of receiving spaces 16. One panel 21 is connected to an upper end portions of the plurality of elastic bodies 2 and located on the top surface 14 of the insulating body 1, another panel 21 is connected to a lower end portions of the plurality of elastic bodies 2 and located on the bottom surface (not labeled) of the insulating body 1. The panels 21 and the elastic bodies 2 are integrally formed, and the panels 21 and the elastic bodies 2 are made of the same material. A plurality of mating holes 23 is formed in the panel 21, a plurality of columns 17 protrudes from the top surface 14 and the bottom surface, and the columns 17 are correspondingly inserted into the plurality of mating holes 23 and support the chip module 200. Alternatively, in other embodiments, a plurality of mating holes 23 is formed in the top surface 14 and the bottom surface, a plurality of columns 17 protrudes from the panel 21, and the columns 17 are correspondingly inserted into the plurality of mating holes 23. In this way, when the elastic bodies 2 are injected into the insulating body 1 and insert molded with the insulating body 1, the elastic bodies 2 having a higher shrinkage rate than the insulating body 1 will not shrink excessively in the insulating body 1 to cause dislocation of the conductor 3 in electrical contact with the chip module 200 and the circuit board 300. In one embodiment, there may be only one panel 21, which is located on the top surface 14.

Figure 5:
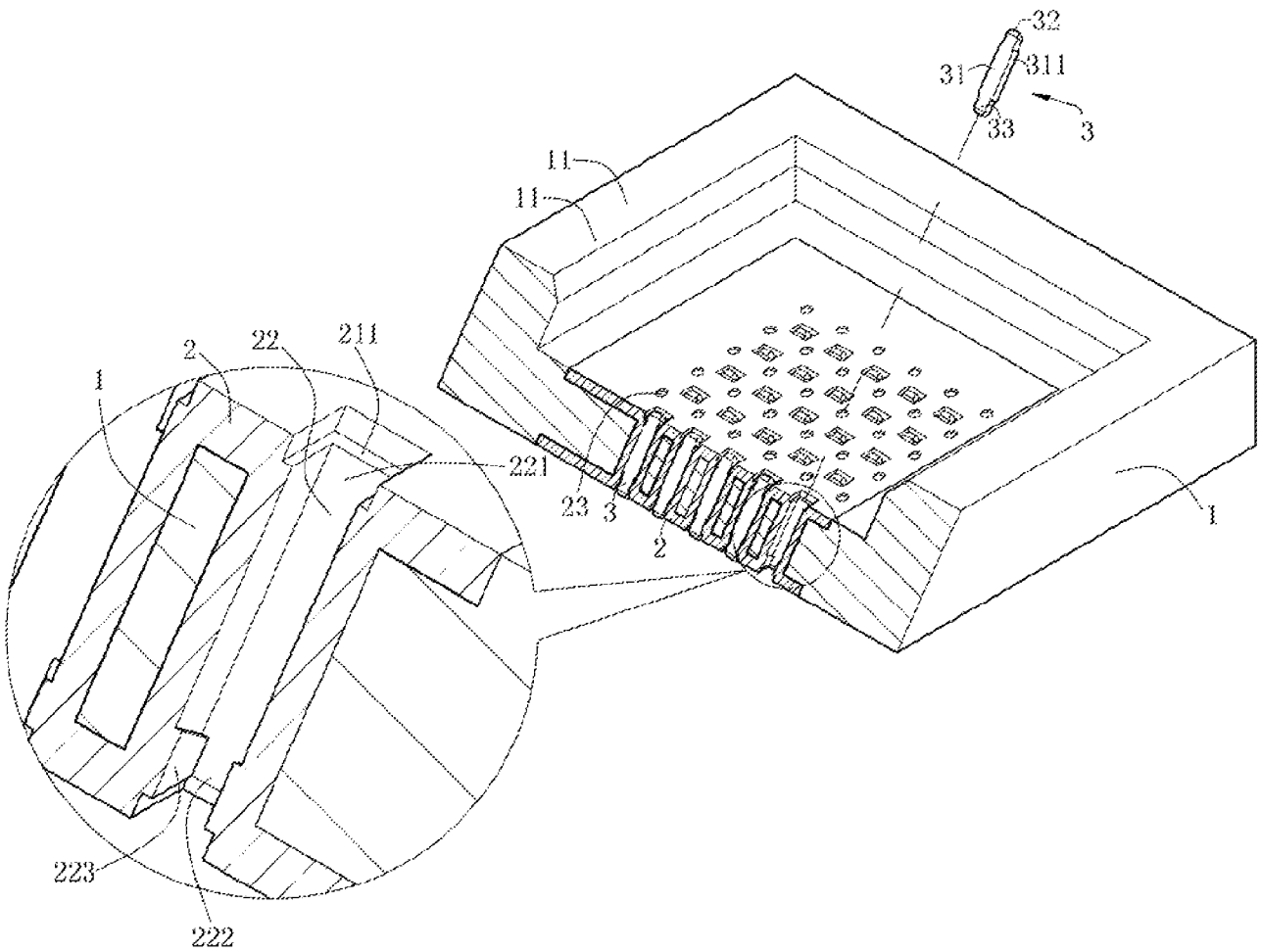
FIG. 5 is a schematic partial enlarged view of the electrical connector according to one embodiment of the present invention.
Figure 6:
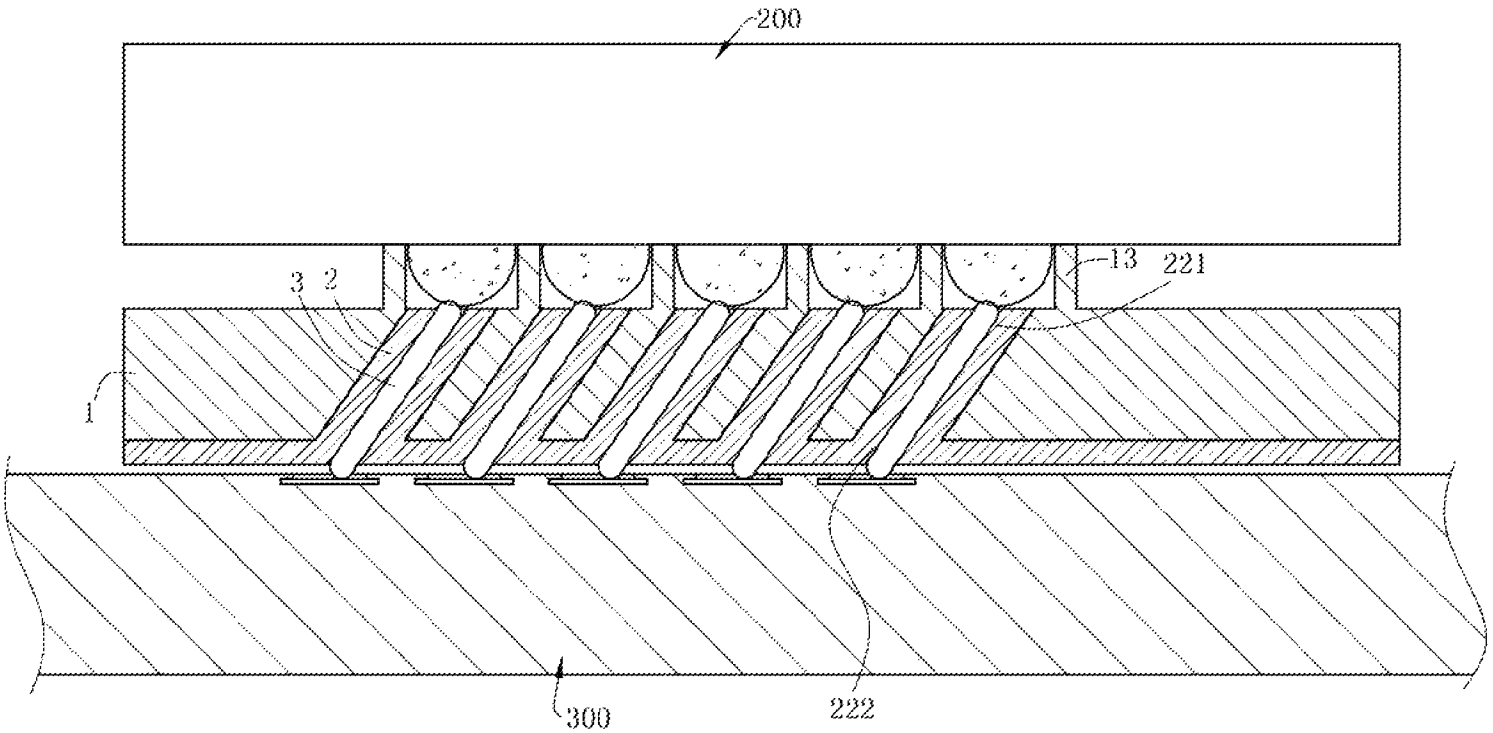
FIG. 6 is a schematic sectional side view of an electrical connector in another embodiment of the present invention.
Figure 7:
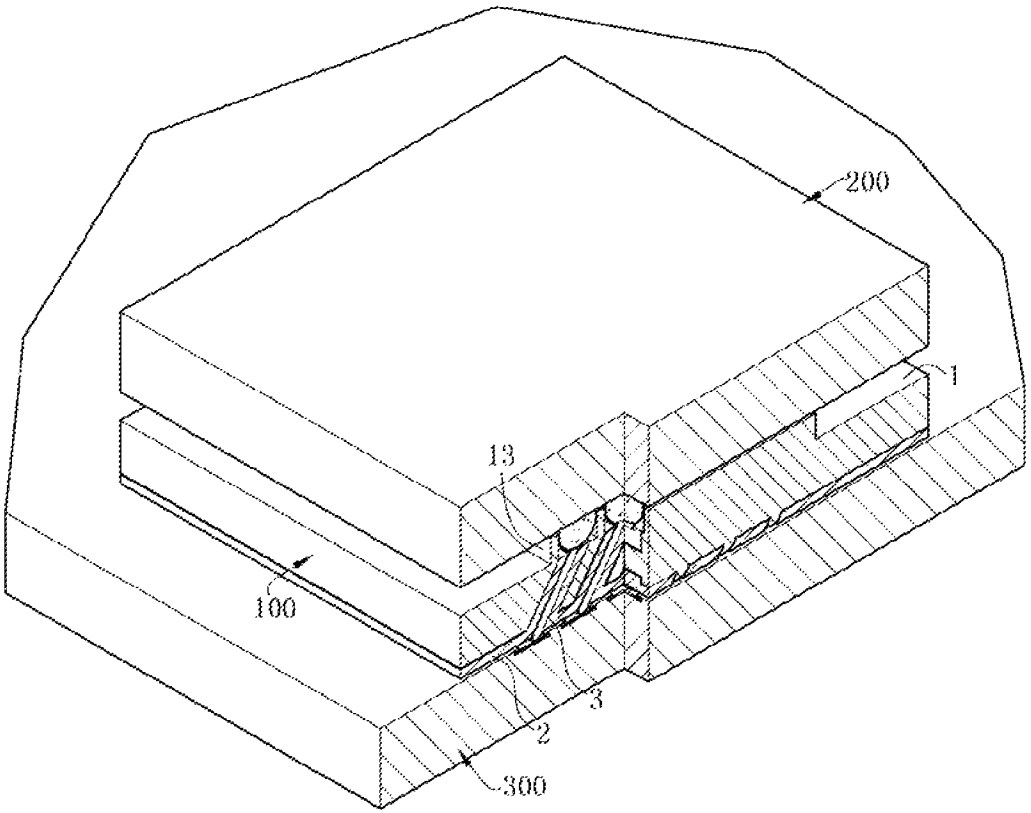
FIG. 7 is a schematic partial sectional view of FIG. 6.
Figure 8:
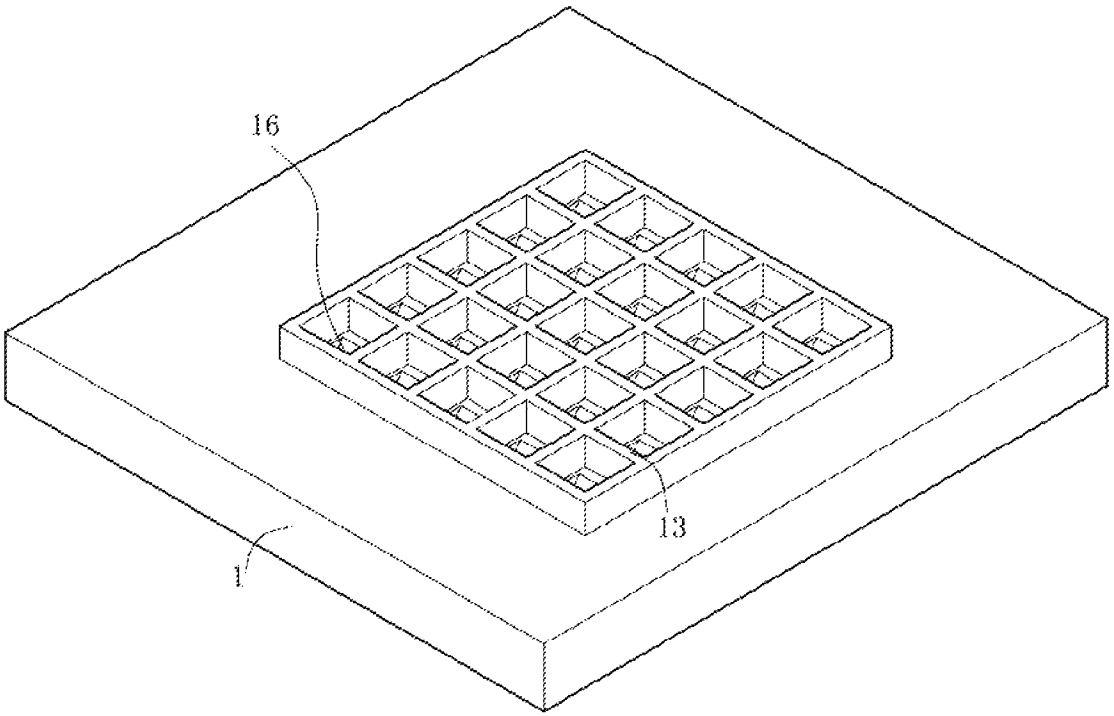
FIG. 8 is a schematic three-dimensional view of an insulating body of an electrical connector in another embodiment of the present invention.
Figure 15:
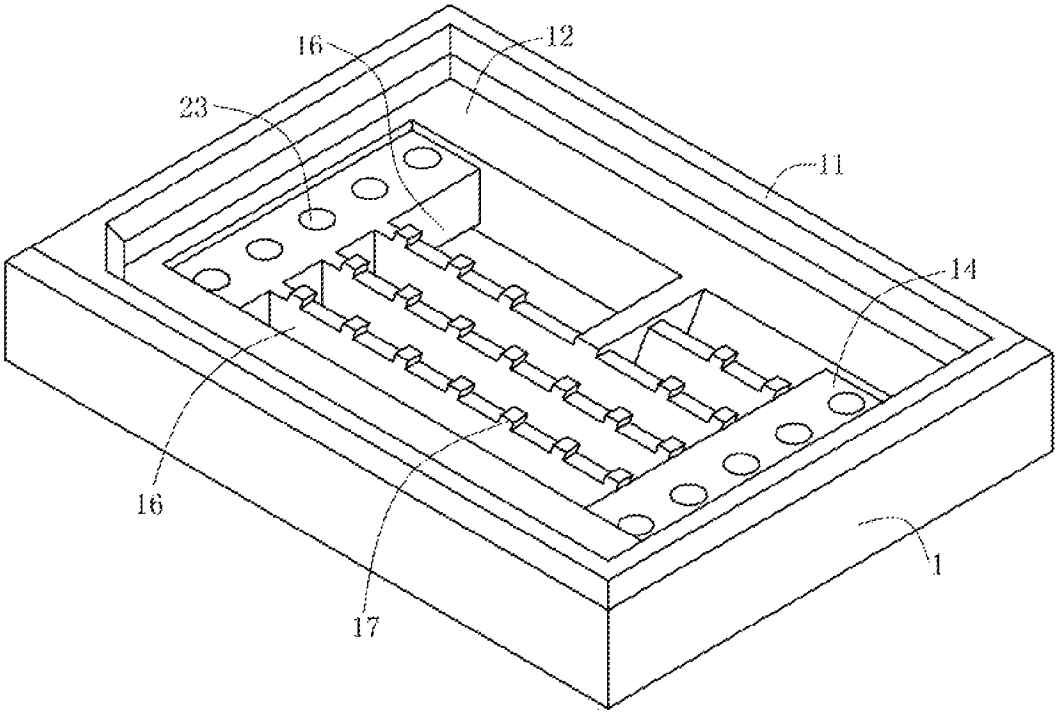
FIG. 15 is a schematic three-dimensional view of the insulating body in FIG. 10.

As shown in FIG. 1 and FIG. 5, a receiving slot 22 is formed through each of the elastic bodies 2, and each of the receiving slots 22 is correspondingly received in one of the receiving spaces 16. Alternatively, two or more receiving spaces 16 may be communicated with each other in a horizontal direction (as shown in FIG. 15), so as to save the space occupied by stop walls between the two or more receiving spaces 16. As shown in FIG. 15, all or a part of the receiving spaces 16 in a same row or column may be communicated with each other, the purpose of which is to prevent contact dislocation caused by excessive shrinking of the elastic bodies 2 as much as possible and to reduce the total volume of the plurality of receiving spaces 16 without changing the total number of the conductors 3 received, thereby facilitating the miniaturization of the electrical connector 100. The receiving slot 22 further has a first opening (not labeled) located at the top surface 14, and a second opening (not labeled) located at the bottom surface (not labeled), the receiving slot 22 communicates the first opening and the second opening, and the first opening and the second opening are staggered in a vertical direction. As shown in FIGS. 3, 5, 10 and 11, a first urging portion 221 is located at a first inner wall of the receiving slot 22, a second urging portion 222 is located at a second inner wall of the receiving slot 22. The first inner wall and the second inner wall are disposed opposite to each other in the receiving slot 22. The receiving slot 22 further has two stopping portions 223 respectively located at a third inner wall and a fourth inner wall of the receiving slot 22. The fourth inner wall and the third inner wall are disposed opposite to each other. The first inner wall, the second inner wall, the third inner wall and the fourth inner wall jointly form the receiving slot 22. Alternatively, there may also be at least two stopping portions 223 at each inner wall, and the first inner wall and the second inner wall may also have the stopping portions 223.

As shown in FIGS. 1-4 and 9-11, a plurality of conductors 3 is correspondingly received in the plurality of receiving slots 22. The conductors 3 are substantially in the shape of a flat plate, a straight column or a straight cylinder, and have a simple structure and a regular shape. The conductor 3 has a body portion 31, a first contact portion 32 extending upwards from the body portion 31 and exposed out of the receiving slot 22 to contact the chip module 200, and a second contact portion 33 extending downwards from the body portion 31 and exposed out of the receiving slot 22 to contact the circuit board 300. A tilt angle exists between the conductor 3 and the bottom surface of the insulating body 1. Due to the existence of the tilt angle, the first contact portion 32 and the second contact portion 33 are not in a same vertical line, that is, the conductors 3 lean inside and press against the elastic bodies 2, so that the elastic bodies 2 can provide an inclined elastic counterforce against the conductors 3. The first urging portion 221 is adjacent to the first contact portion 32 and presses against a first side of the body portion 31. When the first contact portion 32 is press-fit to the chip module 200, the first urging portion 221 undergoes an elastic deformation and provides an inclined upward elastic counterforce against the first contact portion 32. The second urging portion 222 is adjacent to the second contact portion 33 and presses against a second side of the body portion 31. The first side and the second side are disposed opposite to each other on the body portion 31. When the second contact portion 33 is press-fit to the circuit board 300, the second urging portion 222 undergoes an elastic deformation and provides an inclined downward elastic counterforce against the second contact portion 33. To enable the conductors 3 to have a large normal force, and based on the principle of reducing the volume of the electrical connector 100 by increasing the density of the conductors 3 arranged in unit area, in certain embodiments, the tilt angle is most preferably greater than 45° and less than 80°. In this case, the elastic counterforce provides a large normal force against the conductors 3, so that the conductors 3 can be in good electrical contact with the chip module 200 and the circuit board 300, thereby reducing the contact resistance, prolonging the service life of the conductors 3 and relieving fatigue of the conductors 3.

In this embodiment, as shown in FIG. 5, the body portion 31 further has a third side and a fourth side that are disposed opposite to each other. The first side and the second side are connected to the third side and the fourth side. The third side and the fourth side each have a shoulder portion 311 corresponding to the stopping portion 223. The corresponding stopping portion 223 is located below the corresponding shoulder portion 311 to prevent the conductor 3 from falling off from below the receiving slot 22. In a further embodiment, two more stopping portions 233 may be additionally provided. The additionally provided two stopping portions 223 are respectively located above the corresponding shoulder portions 311 to prevent the conductor 3 from falling off from above the receiving slot 22. In addition, a floating space exists between each of the stopping portions 223 and the corresponding shoulder portion 311, so that when the chip module 200 is press-fit to the conductor 3, the conductor 3 can be displaced vertically in the floating space.

Figure 10:
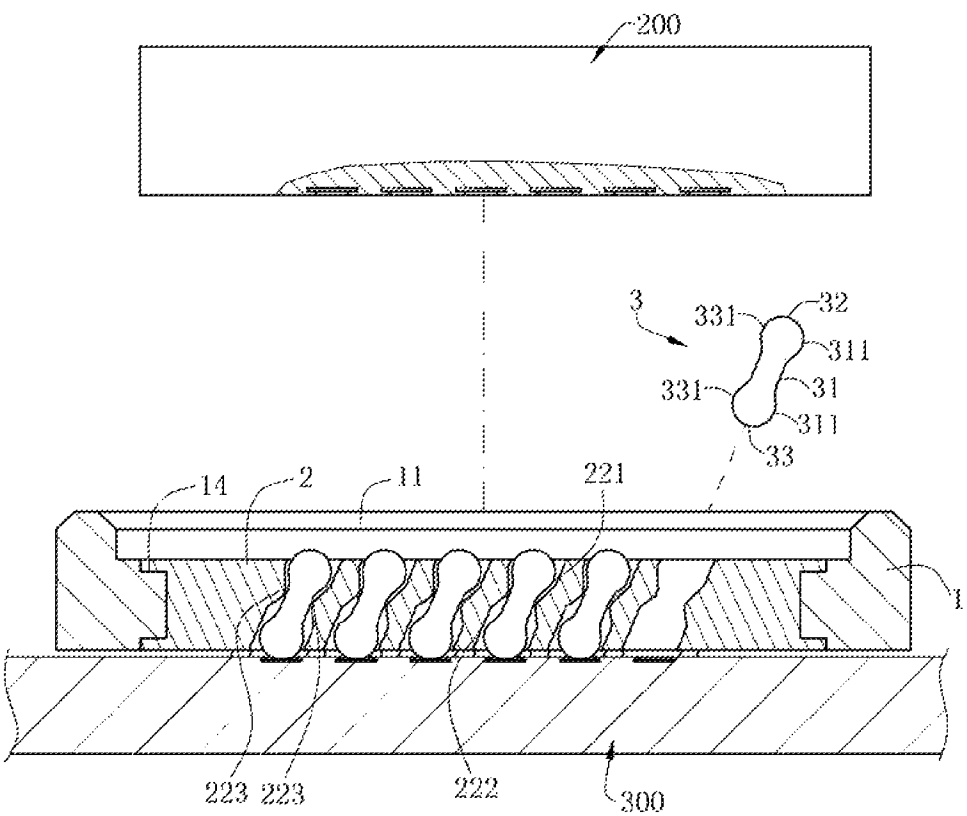
FIG. 10 is a schematic sectional side view of an electrical connector before a chip module is mounted according to another embodiment of the present invention.
Figure 11:
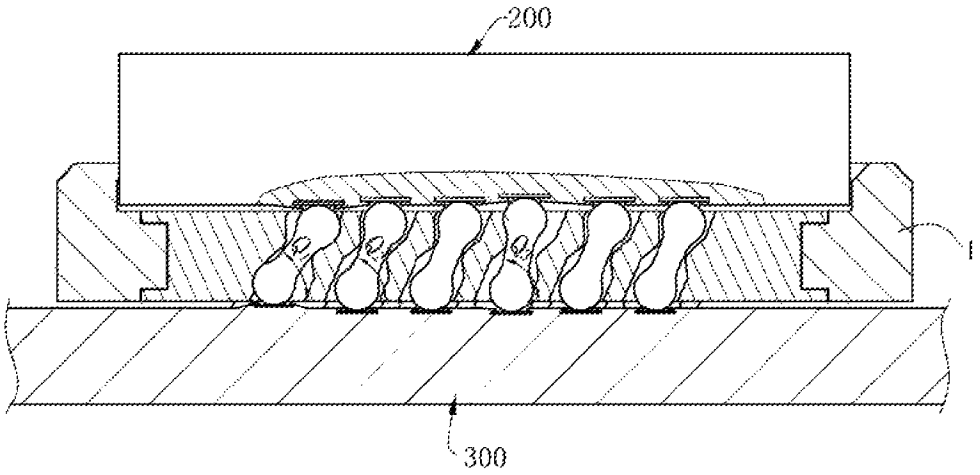
FIG. 11 is a schematic sectional side view showing the change of tilt angles of conductors that are pressed after the chip module in FIG. 10 is mounted.

In other embodiments, as shown in FIG. 10 and FIG. 11, two shoulder portions 311 protrude from each of the first side and the second side of the body portion 31, the first inner wall and the second inner wall of the receiving slot 22 each have one stopping portion 223, and the two shoulder portions 311 at the first side and the two shoulder portions 311 at the second side are respectively located above and below the corresponding stopping portions 223, so that the stopping portion 223 is restricted between the corresponding two shoulder portions 311 to prevent the conductor 3 from falling off from above and below the receiving slot 22.

Figure 9:
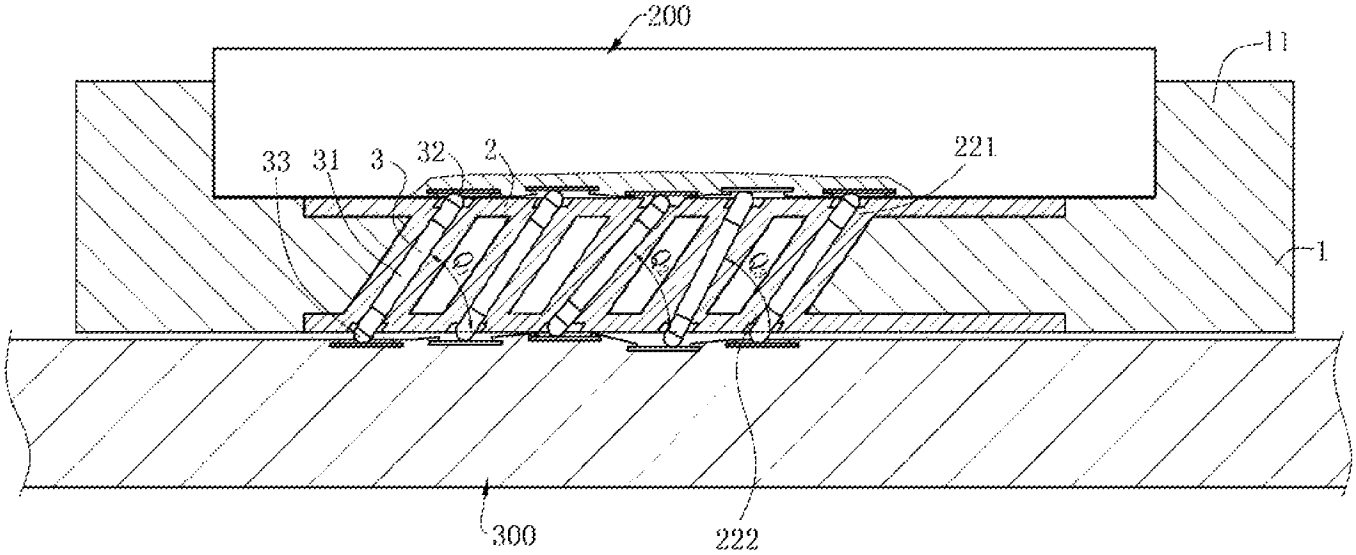
FIG. 9 is a schematic sectional side view showing the change of tilt angles of conductors in the electrical connector after a chip module is mounted according to one embodiment of the present invention.

As shown in FIG. 9 and FIG. 11, when the chip module 200 has poor flatness and the contact surface of the chip module 200 with the first contact portion 32 is uneven, each of the conductors 3 can adjust its tilt angle and vertical displacement properly according to the magnitude of the pressing force received by it. That is, when the plurality of conductors 3 is pressed by the chip module 200, the plurality of conductors 3 compresses the corresponding first urging portions 211 and the corresponding second urging portions 222, so that the corresponding first urging portions 221 and the corresponding second urging portions 222 undergo an elastic deformation. Due to the poor flatness of the chip module 200, the conductors 3 have different compression forces on the corresponding first urging portions 221 and the corresponding second urging portions 222, so that the corresponding first urging portions 221 and the corresponding second urging portions 222 have different degrees of elastic deformation, and different tilt angles exist between the plurality of conductors 3 and the circuit board 300. As shown in FIG. 9 and FIG. 11, tilt angles Q1, Q2 and Q3 are different (alternatively, the present invention is not limited thereto), so that the first contact portions 32 of some of the conductors 3 are at different heights from the first contact portions 32 of the other conductors 3. In addition, due to the existence of the floating space, when the tilt angle of the plurality of conductors 3 changes, the plurality of conductors 3 may be vertically displaced properly in the corresponding receiving slots 22 to adapt to the adjustment of the tilt angle, so as to ensure a good electrical contact of each of the first contact portions 32 and each of the second contact portions 33 with the chip module 200 and the circuit board 300.

In another embodiment, as shown in FIG. 9 and FIG. 11, when the plurality of conductors 3 has different lengths and poor flatness, each of the conductors 3 can adjust its tilt angle and vertical displacement properly according to the magnitude of the pressing force received by it. That is, when the plurality of conductors 3 is pressed by the chip module 200, the plurality of conductors 3 compresses the corresponding first urging portions 211 and the corresponding second urging portions 222, so that the corresponding first urging portions 221 and the corresponding second urging portions 222 undergo an elastic deformation. Due to the different lengths and poor flatness of the plurality of conductors 3, the chip module 200 has widely different pressing forces on the plurality of conductors 3, and therefore the plurality of conductors 3 has different compression forces on the corresponding first urging portions 221 and the corresponding second urging portions 222, so that the corresponding first urging portions 221 and the corresponding second urging portions 222 have different degrees of elastic deformation, leading to different tilt angles between the plurality of conductors 3 and the circuit board 300. As shown in FIG. 9 and FIG. 11, tilt angles Q1, Q2 and Q3 are different (alternatively, the present invention is not limited thereto), and eventually, the first contact portion 32 of each of the conductors 3 is at a same height as the first contact portions 32 of the other conductors 3. In addition, due to the existence of the floating space, when the tilt angle of the plurality of conductors 3 changes, the plurality of conductors 3 may be vertically displaced properly in the corresponding receiving slots 22 to adapt to the adjustment of the tilt angle, so as to ensure a good electrical contact of each of the first contact portions 32 and each of the second contact portions 33 with the chip module 200 and the circuit board 300.

As shown in FIG. 2 to FIG. 5, this embodiment has two panels 21 respectively located on the top surface 14 and the bottom surface (not shown). Each of the panels 21 is formed with a plurality of notches 211 each corresponding to one of the receiving slots 22 and communicated with the receiving slot 22. Each of the notches 211 accommodates a low-melting point metal, and the low-melting point metal surrounds and covers the first contact portion 32 and the second contact portion 33, which increases the contact areas of the first contact portion 32 and the second contact portion 33 with the chip module 200 and the circuit board 300, reduces the contact resistance, and ensures a good electrical contact. Alternatively, in other embodiments, the low-melting point metal is coated on the first contact portion 32 and the second contact portion 33 only. The low-melting point metal described in certain embodiment of the present invention is gallium or gallium alloy, and the low-melting point metal is in liquid form at normal temperature.

Figure 3:
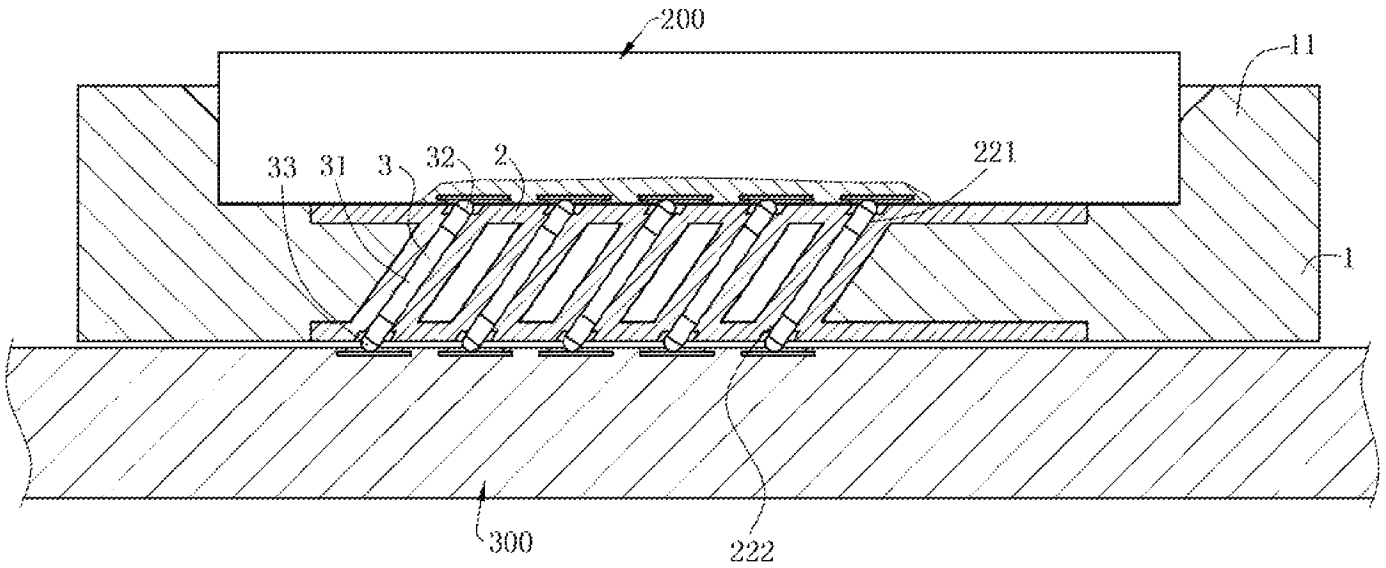
FIG. 3 is a schematic sectional side view after a chip module in FIG. 2 is mounted.
Figure 4:
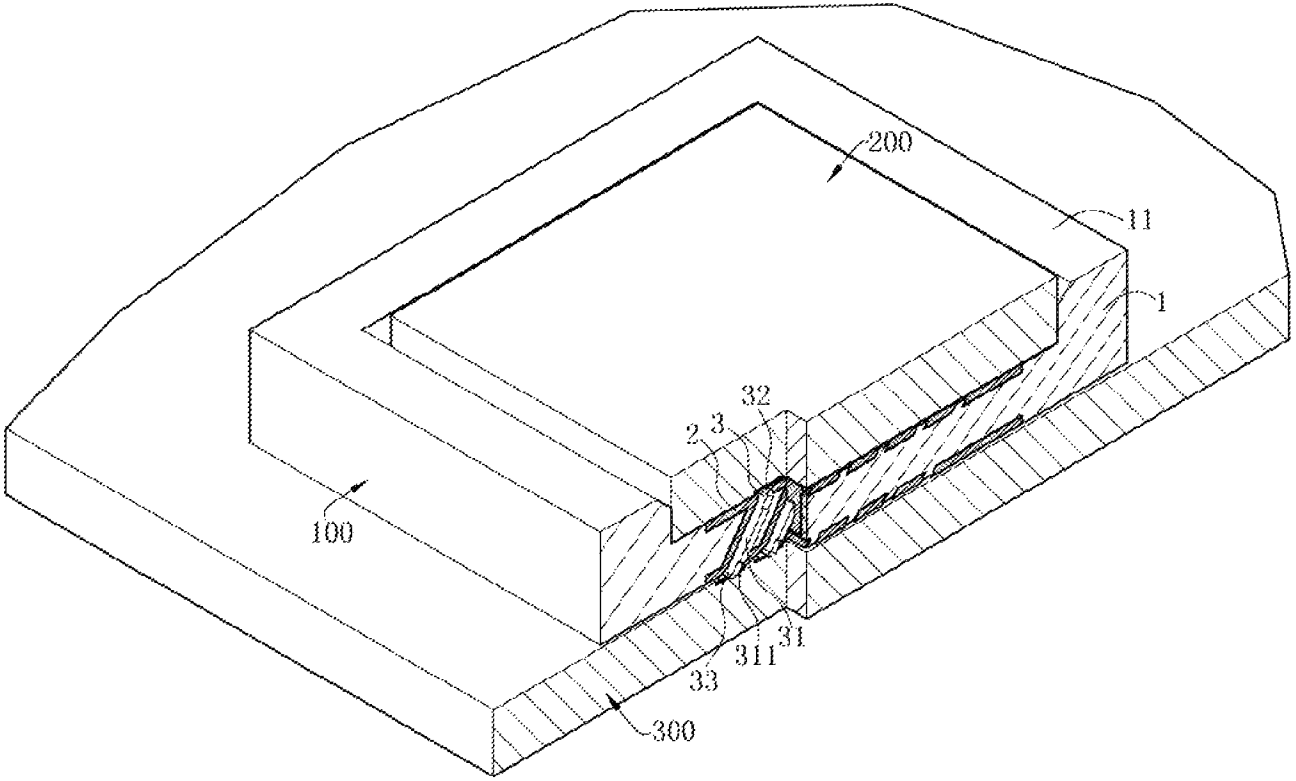
FIG. 4 is a schematic partial sectional view of the electrical connector according to one embodiment of the present invention.

As shown in FIG. 1 to FIG. 3, during assembly, first, the elastic bodies 2 are insert molded with the insulating body 1. Next, the conductors 3 are assembled into the receiving slots 22 of the elastic bodies 2 in an inclined manner, and when the conductors 3 are press-fit to the chip module 200 and the circuit board 300, the receiving slots 22 provide an inclined elastic counterforce for the conductors 3, so that the conductors 3 have a large normal force to contact the chip module 200 and the circuit board 300. Then, the assembled electrical connector 100 is assembled between the chip module 200 and the circuit board 300. Due to the existence of the floating space between the stopping portion 223 and the corresponding shoulder portion 311, after the electrical connector 100 is assembled to the chip module 200 and the circuit board 300, each of the conductors 3 is compressed by the chip module 200 and the circuit board 300, and each of the conductors 3 automatically adjusts its tilt angle and vertical displacement in the receiving slot 22 properly according to the magnitude of the pressing force received by it, so as to finally ensure a good electrical contact of each of the conductors 3 with the chip module 200 and the circuit board 300.

Based on the above, the electrical connector 100 according to certain embodiment of the present invention, among other things, has the following beneficial advantages.

(1) The conductor 3 has a tilt angle with respect to the bottom surface (not shown) of the insulating body, so that the first contact portion 32 and the second contact portion 33 are not in a same vertical line. The first urging portion 221 is adjacent to the first contact portion 32 and presses against the first side of the body portion 31. When the first contact portion 32 is press-fit to the chip module 200, the first urging portion 221 undergoes an elastic deformation and provides an inclined upward elastic counterforce against the first contact portion 32. The second urging portion 222 is adjacent to the second contact portion 33 and presses against the second side of the body portion 31, and the first side and the second side are disposed opposite to each other. When the second contact portion 33 is press-fit to the circuit board 300, the second urging portion 222 undergoes an elastic deformation and provides an inclined downward elastic counterforce against the second contact portion 33. The elastic counterforce provides a large normal force for the conductors 3, so that the conductors 3 can be in good electrical contact with the chip module 200 and the circuit board 300, thereby reducing the contact resistance, prolonging the service life of the conductors 3 and relieving fatigue of the conductors 3.

(2) Due to the existence of the floating space between each of the stopping portions 223 and the corresponding shoulder portion 311, when the conductor 3 is pressed by the chip module 200, the conductor 3 can be displaced vertically in the floating space. Especially when the chip module 200 has poor flatness and the contact surface of the chip module 200 with the first contact portion 32 is uneven, each of the conductors 3 can adjust its tilt angle and vertical displacement properly according to the magnitude of the pressing force received by it, so as to ensure a good electrical contact between the contact surface of the chip module 200 with each of the first contact portions 32.

(3) Each of the notches 211 accommodates a low-melting point metal, and the low-melting point metal surrounds and covers the first contact portion 32 and the second contact portion 33, which increases the respective contact areas of the first contact portion 32 and the second contact portion 33 with the chip module 200 and the circuit board 300, reduces the contact resistance, and ensures a good electrical contact.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, for electrically connecting a first electronic element and a second electronic element, comprising:

an insulating body, having a top surface and a bottom surface, wherein a plurality of receiving spaces runs through the top surface and the bottom surface;

a plurality of elastic bodies, correspondingly located in the plurality of receiving spaces of the insulating body, wherein a receiving slot is formed through each of the elastic bodies, the receiving slot has a first opening and a second opening, the first opening and the second opening are staggered in a vertical direction, and two opposite sides of the receiving slot respectively have a first urging portion and a second urging portion; and a plurality of conductors, correspondingly received in the plurality of receiving slots, wherein each of the conductors has a tilt angle with respect to the bottom surface, and comprises:

a body portion;

a first contact portion extending upwards from the body portion, and exposed out of the top surface to contact the first electronic element; and a second contact portion extending downwards from the body portion, and exposed out of the bottom surface to contact the second electronic element, wherein the first urging portion is adjacent to the first contact portion and presses against a first side of the body portion, and the first urging portion provides an inclined upward elastic counterforce against the first contact portion when the first contact portion is pressed; and wherein the second urging portion is adjacent to the second contact portion and presses against a second side of the body portion, the second side and the first side are disposed opposite to each other, and the second urging portion provides an inclined downward elastic counterforce against the second contact portion when the second contact portion is pressed.

2. The electrical connector according to claim 1, wherein the body portion further comprising a third side and a fourth side disposed opposite to each other, the first side and the second side are connected to the third side and the fourth side, the third side or the fourth side is provided with at least one shoulder portion, the receiving slot is provided with at least one stopping portion, and the stopping portion is located below or above the corresponding shoulder portion to prevent the conductor from falling off from below or above the receiving slot.

3. The electrical connector according to claim 2, wherein the receiving slot has two stopping portions, the third side or the fourth side has one shoulder portion, and the two stopping portions are respectively located above and below the shoulder portion.

4. The electrical connector according to claim 3, wherein a floating space exists between the stopping portion and the corresponding shoulder portion.

5. The electrical connector according to claim 1, further comprising two shoulder portions protruding from the first side or the second side of the body portion, wherein the receiving slot is provided with at least one stopping portion, and the two shoulder portions are respectively located above and below the stopping portion.

6. The electrical connector according to claim 5, wherein a floating space exists between the stopping portion and the corresponding shoulder portion.

7. The electrical connector according to claim 1, wherein the tilt angle between the conductor and the bottom surface is greater than 45° and less than 80°.

8. The electrical connector according to claim 1, wherein when the first contact portions and the second contact portions are pressed, the first contact portion or the second contact portion of at least one of the conductors is at a different height from the first contact portions or the second contact portions of the other conductors.

9. The electrical connector according to claim 1, wherein when the first contact portions and the second contact portions are pressed, the tilt angle of at least one of the conductors with respect to the bottom surface is different from the tilt angles of the other conductors with respect to the bottom surface.

10. The electrical connector according to claim 1, wherein the elastic bodies are insert molded with the insulating body.

11. The electrical connector according to claim 1, further comprising a panel connected to the plurality of elastic bodies and located on the top surface or the bottom surface of the insulating body, wherein the panel and the elastic bodies are made of a same material.

12. The electrical connector according to claim 11, wherein the panel has a plurality of first mating holes or a plurality of first columns, and the top surface or the bottom surface correspondingly has a plurality of second columns for mating with the plurality of first mating holes, or provided with a plurality of second mating holes for mating with the plurality of first columns.

13. The electrical connector according to claim 12, wherein the electrical connector has two panels, and the two panels are respectively located on the top surface and the bottom surface.

14. The electrical connector according to claim 1, wherein at least two of the receiving spaces are communicated with each other in a horizontal direction.

15. The electrical connector according to claim 1, wherein the conductor is substantially a flat plate structure, a straight column structure or a straight cylinder structure.

16. The electrical connector according to claim 1, wherein at least one of the first contact portion and the second contact portion is coated with a low-melting point metal.

17. The electrical connector according to claim 1, wherein the elastic body comprises two surfaces disposed opposite to each other, at least one of the surfaces is formed with a plurality of notches correspondingly communicating with the plurality of receiving slots, each of the notches accommodates a low-melting point metal, and the low-melting point metal covers the first contact portion or the second contact portion.

18. The electrical connector according to claim 17, wherein the low-melting point metal is gallium or gallium alloy, and the low-melting point metal is in liquid form.

19. The electrical connector according to claim 1, further comprising a plurality of limiting walls protruding from a periphery of the insulating body to limit displacement of the first electronic element in a horizontal direction.

20. The electrical connector according to claim 1, further comprising a plurality of protruding portions protruding from the insulating body, and supporting the first electronic element, wherein the protruding portions are located at a periphery of the top surface and higher than the top surface.

21. The electrical connector according to claim 1, further comprising at least one protruding rib formed around the receiving space, wherein the protruding rib is higher than the top surface and supports the first electronic element.

22. The electrical connector according to claim 1, wherein a plurality of positioning members are provided on one of the insulating body and the second electronic element, and a plurality of positioning holes correspondingly matching with the plurality of positioning members are defined in the other of the insulating body and the second electronic element, and the positioning members are correspondingly fixed in the positioning holes.

* * * * *